US009046852B2

(12) United States Patent
Cui et al.

(10) Patent No.: US 9,046,852 B2
(45) Date of Patent: Jun. 2, 2015

(54) METHOD FOR DETERMINING ABNORMALITY OF TEMPERATURE SENSOR AND IMAGE FORMING APPARATUS USING THE SAME

(71) Applicants: Changli Cui, Shanghai (CN); Tianji Xu, Shanghai (CN); Gui Chen, Shanghai (CN)

(72) Inventors: Changli Cui, Shanghai (CN); Tianji Xu, Shanghai (CN); Gui Chen, Shanghai (CN)

(73) Assignee: RICOH COMPANY, LTD., Tokyo (JP)

( * ) Notice: Subject to any disclaimer, the term of this patent is extended or adjusted under 35 U.S.C. 154(b) by 76 days.

(21) Appl. No.: 14/026,137

(22) Filed: Sep. 13, 2013

(65) Prior Publication Data

US 2014/0086600 A1 Mar. 27, 2014

(30) Foreign Application Priority Data

Sep. 27, 2012 (CN) ..... 2012 1 0375487

(51) Int. Cl.

*G03G 15/00* (2006.01)
*G03G 21/20* (2006.01)
*G03G 15/20* (2006.01)

(52) U.S. Cl.

CPC ..... *G03G 15/55* (2013.01); *G03G 15/2017* (2013.01); *G03G 21/20* (2013.01)

(58) Field of Classification Search

CPC ..... G03G 15/2039; G03G 15/55; G03G 15/2053; G03G 15/205; G03G 15/80; G03G 15/2078; G03G 15/5004; H01H 2037/549; H05B 1/0202; H05B 6/06

USPC ..... 399/33, 67, 122, 320

See application file for complete search history.

(56) References Cited

U.S. PATENT DOCUMENTS

| | | | | |
|---|---|---|---|---|
| 2011/0058826 | A1* | 3/2011 | Jeong et al. | 399/33 |
| 2011/0076037 | A1* | 3/2011 | Fukushi | 399/33 |
| 2011/0164889 | A1* | 7/2011 | Deng | 399/33 |
| 2012/0121277 | A1* | 5/2012 | Kim | 399/33 |
| 2012/0141150 | A1* | 6/2012 | Noh | 399/33 |

* cited by examiner

*Primary Examiner* — Francis Gray

(74) *Attorney, Agent, or Firm* — Harness, Dickey & Pierce, P.L.C.

(57) ABSTRACT

A method for determining abnormality of a temperature sensor and the image forming apparatus, the method comprises: detecting an actual temperature of a fixing apparatus and an input voltage; calculating an actual temperature variation amount in a predetermined time period; comparing the detected input voltage and a predetermined voltage; comparing the calculated actual temperature variation amount and a first reference temperature variation amount if the input voltage is greater than the predetermined voltage; determining that the temperature sensor is abnormal if the actual temperature variation amount is less than the first reference temperature variation amount; comparing the calculated actual temperature variation amount and a smaller second reference temperature variation amount if the input voltage is equal to or less than the predetermined voltage; determining that the temperature sensor is abnormal if the actual temperature variation amount is less than the second reference temperature variation amount.

14 Claims, 4 Drawing Sheets

METHOD FOR DETERMINING ABNORMALITY OF TEMPERATURE SENSOR AND IMAGE FORMING APPARATUS USING THE SAME

BACKGROUND OF THE INVENTION

1. Field of the Invention

The present invention relates to a method for determining abnormality of a temperature sensor used in an image forming apparatus and the image forming apparatus using the same.

2. Description of the Related Art

Conventionally, the image forming apparatus performs fixing at a predetermined temperature so that toner is controlled to form an image on a sheet, and controls a fixing lamp by detecting the temperature of a temperature sensor of a fixing apparatus. The abnormality or failure of the fitting of a temperature sensor may lead to an error of the detected temperature, as a result, a fire, or even damage to the machine may be caused.

Accordingly, as a usual method for detecting whether the temperature sensor is normal or not, it is determined whether the temperature variation amount of the fixing apparatus in a predetermined time period reaches a predetermined reference temperature variation amount or not. If the risen temperature variation amount in a predetermined time period is less than the predetermined reference temperature variation amount, it is determined that the temperature sensor is abnormal.

However, the risen temperature variation amount in a predetermined time period may also be less than the predetermined reference temperature variation amount, when an input voltage is less than a predetermined voltage. So that, in this case, it may be determined that the temperature sensor is abnormal because of instability of the input voltage, even though the temperature sensor is normal.

SUMMARY OF THE INVENTION

The present invention provides a method for determining abnormality of a temperature sensor used in an image forming apparatus to solve the problems described above.

According to an aspect of the embodiment of the present invention, a method for determining abnormality of a temperature sensor used in an image forming apparatus comprises the steps of: detecting an actual temperature of a fixing apparatus of the image forming apparatus and an input voltage which is input into the image forming apparatus; calculating an actual temperature variation amount of the actual temperature between a start time and an end time of a predetermined time period; comparing the detected input voltage and a predetermined voltage; comparing the calculated actual temperature variation amount and a predetermined first reference temperature variation amount if the input voltage is greater than the predetermined voltage; determining that the temperature sensor is normal if the actual temperature variation amount is equal to or greater than the first reference temperature variation amount; and determining that the temperature sensor is abnormal if the actual temperature variation amount is less than the first reference temperature variation amount; and comparing the calculated actual temperature variation amount and a predetermined second reference temperature variation amount which is less than the first reference temperature variation amount if the input voltage is equal to or less than the predetermined voltage; determining that the temperature sensor is normal if the actual temperature variation amount is equal to or greater than the second reference temperature variation amount; and determining that the temperature sensor is abnormal if the actual temperature variation amount is less than the second reference temperature variation amount. Furthermore, the second reference temperature variation amount may be a predetermined value or may be a predetermined set of values corresponding to different input voltage regions.

According to another aspect of the embodiment of the present invention, an image forming apparatus for forming an image on a sheet comprises: a fixing apparatus configured to fix toner for forming the image onto the sheet; a temperature sensor configured to detect an actual temperature of the fixing apparatus; an input voltage detection and comparison circuit configured to detect an input voltage which is input into the image forming apparatus, compare the input voltage and a predetermined voltage, and output a comparison result; and a processor unit, wherein the processor unit receives the actual temperature of the fixing apparatus detected by the temperature sensor and the comparison result of the voltages output by the input voltage detection and comparison circuit, and calculates an actual temperature variation amount of the actual temperature between a start time and an end time of a predetermined time period, wherein the processor unit compares the calculated actual temperature variation amount and a predetermined first reference temperature variation amount if the comparison result is that the input voltage is greater than the predetermined voltage, determines that the temperature sensor is normal if the actual temperature variation amount is equal to or greater than the first reference temperature, and determines that the temperature sensor is abnormal if the actual temperature variation amount is less than the first reference temperature, wherein the processor compares the calculated actual temperature variation amount and a predetermined second reference temperature variation amount which is less than the first reference temperature variation amount if the comparison result is that the input voltage is equal to or less than the predetermined voltage, determines that the temperature sensor is normal if the actual temperature variation amount is equal to or greater than the second reference temperature, and determines that the temperature sensor is abnormal if the actual temperature variation amount is less than the second reference temperature. Furthermore, the second reference temperature variation amount may be a predetermined value.

According to another aspect of the embodiment of the present invention, an image forming apparatus for forming an image on a sheet comprises: a fixing apparatus configured to fix toner for forming the image onto the sheet; a temperature sensor configured to detect an actual temperature of the fixing apparatus; an input voltage detection circuit configured to detect an input voltage which is input into the image forming apparatus, and output the detected input voltage; and a processor unit, wherein the processor unit receives the actual temperature of the fixing apparatus detected by the temperature sensor and the detected input voltage output by the input voltage detection circuit, and calculates an actual temperature variation amount of the actual temperature between a start time and an end time of a predetermined time period; wherein the processor unit compares the input voltage and a predetermined voltage, compares the calculated actual temperature variation amount and a predetermined first reference temperature variation amount if the input voltage is greater than the predetermined voltage, determines that the temperature sensor is normal if the actual temperature variation amount is equal to or greater than the first reference temperature, and determines that the temperature sensor is abnormal if the actual temperature variation amount is less than the first reference temperature; wherein the processor compares the calculated actual temperature variation amount and a predetermined second reference temperature variation amount which is less than the first reference temperature variation amount if the input voltage is equal to or less than the predetermined voltage, determines that the temperature sensor is normal if the actual temperature variation amount is equal to or greater than the second reference temperature, and determines that the temperature sensor is abnormal if the actual temperature variation amount is less than the second reference temperature. Furthermore, the second reference temperature variation amount may be a predetermined set of values corresponding to different input voltage regions.

According to the image forming apparatus of the present invention, it is possible to determine that abnormality is caused by abnormality of the temperature detector or instability of the input voltage. The image forming apparatus will be controlled to ensure convenience for the user, if abnormality is caused by the input voltage,

DETAILED DESCRIPTION OF THE PREFERRED EMBODIMENTS

The predetermined voltage varies by region, for example, the predetermined voltage is 100V for Japan and is 110V for Taiwan. In the following examples, 220V AC voltage of China is set as the predetermined voltage Vac', and a preferable example of the method for determining abnormality of the temperature sensor used in the image forming apparatus according to the present invention is described in detail.

The method for determining abnormality of the temperature sensor used in the image forming apparatus according to the present invention, comprises the steps of: detecting an actual temperature of a fixing apparatus of the image forming apparatus and an input voltage which is input into the image forming apparatus; calculating an actual temperature variation amount of the actual temperature between a start time and an end time of a predetermined time period; comparing the detected input voltage and a predetermined voltage; comparing the calculated actual temperature variation amount and a predetermined first reference temperature variation amount if the input voltage is greater than the predetermined voltage; determining that the temperature sensor is normal if the actual temperature variation amount is equal to or greater than the first reference temperature variation amount; determining that the temperature sensor is abnormal if the actual temperature variation amount is less than the first reference temperature variation amount; and controlling the image forming apparatus so as to operate the image forming apparatus normally if it is determined that the temperature sensor is normal; and comparing the calculated actual temperature variation amount and a predetermined second reference temperature variation amount which is less than the first reference temperature variation amount if the input voltage is equal to or less than the predetermined voltage; determining that the temperature sensor is normal if the actual temperature variation amount is equal to or greater than the second reference temperature variation amount; determining that the temperature sensor is abnormal if the actual temperature variation amount is less than the second reference temperature variation amount; and controlling the image forming apparatus so as to stop the operation of the image forming apparatus if it is determined that the temperature sensor is abnormal.

The First Embodiment

Figure 1:
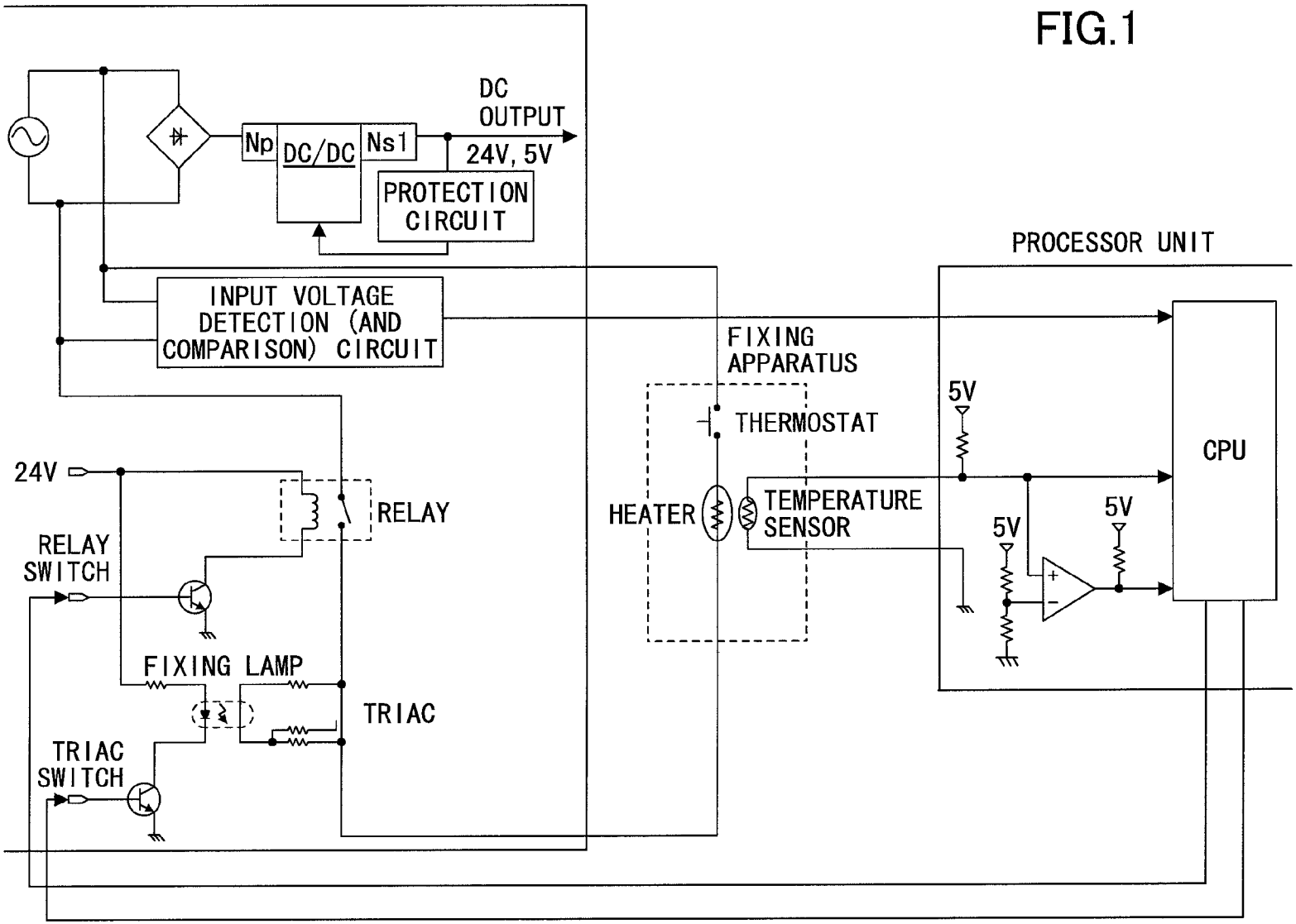
FIG. 1 is a schematic drawing illustrating a fixing control circuit of the image forming apparatus according to the present invention.

In the following, the method for determining abnormality of the temperature sensor used in the image forming apparatus according to the first embodiment of the present invention will be described with reference to FIGS. 1 to 3. In the first embodiment, FIG. 1 is a schematic drawing illustrating a fixing control circuit of the image forming apparatus in which the input voltage detection and comparison circuit is added according to the present invention.

The fixing control circuit of the image forming apparatus comprises: an input voltage Vac; an input voltage detection and comparison circuit configured to detect an input voltage which is input into the image forming apparatus, compare the input voltage and the predetermined voltage 220V, and outputs a comparison result; a relay and a triac; a relay switch and a triac switch; a fixing lamp; a fixing apparatus configured to fix toner for forming the image onto a sheet; a processor unit configured to process data from units of the image forming apparatus and control operation of the image forming apparatus; a temperature sensor configured to detect an actual temperature of the fixing apparatus; and other units.

After the power of the image forming apparatus is turned ON, the processor unit turns on the relay and the triac switch, so that the fixing lamp is turned on, a 24V power supply is output to the fixing control circuit by the relay and the triac, and the heating of the fixing apparatus starts.

Figure 2:
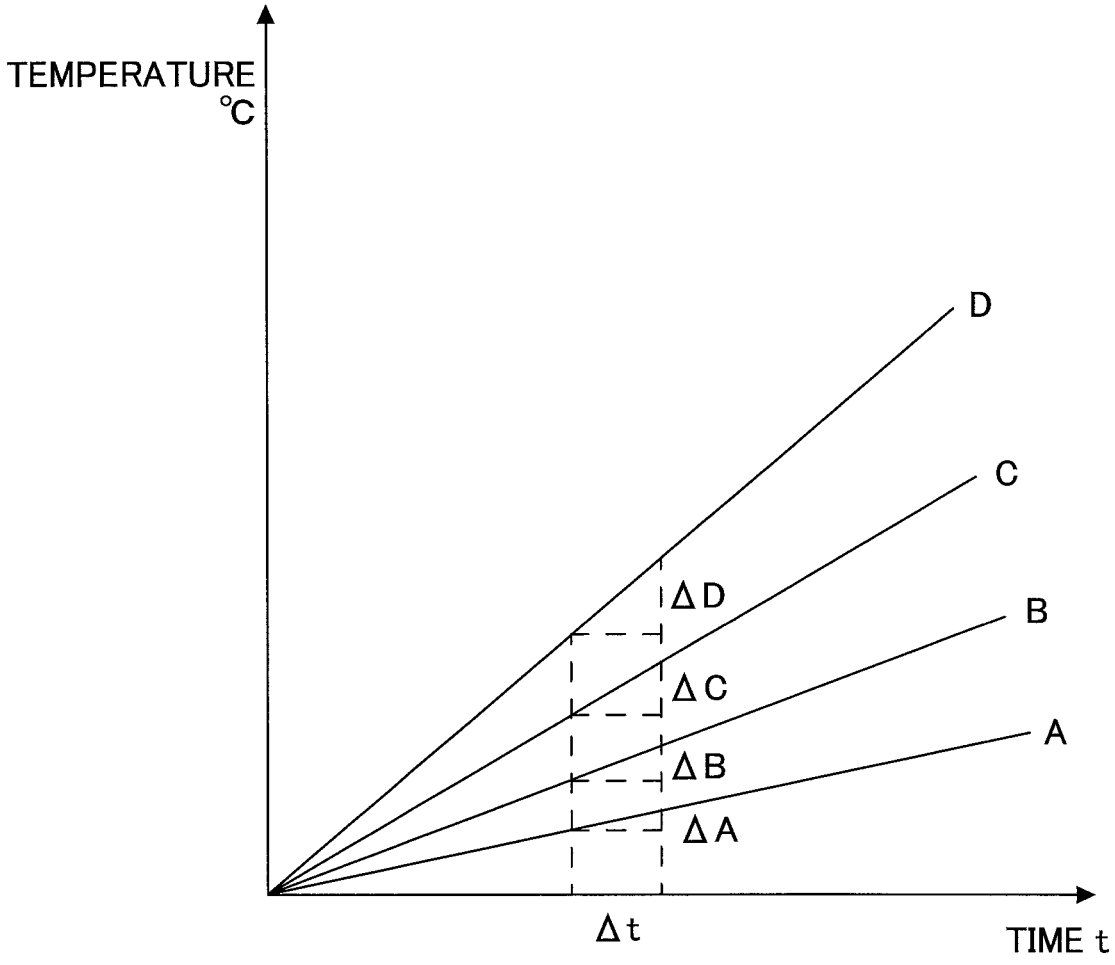
FIG. 2 is an example illustrating control curves of the light of the fixing lamp in different conditions of the input voltage.

FIG. 2 is an example illustrating control curves of the light of the fixing lamp in different conditions of the input voltage. The curves A, B, C and D in FIG. 2 represent the control curves of the light of the fixing lamp in cases where the input voltage $Vac \leq 180V$, $180V < Vac \leq 200V$, $200V < Vac \leq 220V$ and $Vac > 220V$, respectively. The control curves are approximated to straight lines. As illustrated in FIG. 2, the temperature variation amount during the fixing in input voltage regions are $\Delta A = 4°$ C., $\Delta B = 6°$ C., $\Delta C = 7°$ C. and $\Delta D = 8°$ C., respectively, when the time period $\Delta t = 1.5$ s, where $\Delta D$ is the first reference temperature variation amount of the present embodiment and $\Delta A$ is the second reference temperature variation amount of the present embodiment.

Next, how to apply the method for determining abnormality of the temperature sensor in the image forming apparatus will be described with reference to a detailed example.

First, after the power of the image forming apparatus is turned ON, the fixing lamp is turned on and the heating of the fixing apparatus starts. At this time, the temperature sensor detects the actual temperature of the fixing apparatus in real-time and transmits the detected actual temperature to the processor unit via an interface of the processor unit; at the same time, the input voltage detection and comparison circuit begins to detect the AC voltage, which is input into the image forming apparatus, in real-time. Then, the processor unit calculates an actual temperature difference between both ends of a 1.5 s time period Δt as an actual temperature variation amount ΔT based on an actual temperature from the temperature sensor; and the input voltage detection and comparison circuit compares the input voltage and the predetermined voltage 220V.

The processor unit extracts the predetermined ΔD=8° C. as the first reference temperature variation amount and compares the calculated actual temperature variation amount ΔT and ΔD, if the input voltage is greater than the predetermined voltage 220V. The processor unit further determines that the temperature sensor is normal, controls the image forming apparatus so as to operate the image forming apparatus normally, makes the fixing lamp remain in a lighting state and makes the fixing apparatus keep heating, if ΔT≥ΔD; and the processor unit further determines that the temperature sensor is abnormal, turns off the relay and the triac switch so that the fixing lamp is turned off and the relay and the triac stop outputting the power supply 24V to the fixing control circuit, makes the fixing apparatus stop heating, and stops the operation of the image forming apparatus, if ΔT<ΔD.

The second reference temperature variation amount may be a predetermined value.

The processor unit extracts the predetermined ΔA=4° C. as the second reference temperature variation amount and compares the calculated actual temperature variation amount ΔT and ΔA, if the input voltage is equal to or less than the predetermined voltage 220V. The processor unit further determines that the temperature sensor is normal, controls the image forming apparatus so as to operate the image forming apparatus normally, makes the fixing lamp remain in a lighting state and makes the fixing apparatus keep heating, if ΔT≥ΔA; and the processor unit further determines that the temperature sensor is abnormal, turns off the relay and the triac switch so that the fixing lamp is turned off and the relay and the triac stop outputting the power supply 24V to the fixing control circuit, makes the fixing apparatus stop heating, and stops the operation of the image forming apparatus, if ΔT<ΔA.

The abnormality determination of the temperature sensor is performed repeatedly during operation of the image forming apparatus.

If the temperature sensor is normal and the detected actual temperature of the fixing apparatus has reached 170° C. and there is an image processing job such as a print job in the image processing apparatus, the image forming apparatus starts printing when the actual temperature of the fixing apparatus reaches 170° C. If there is not a print job within 1 minute after the actual temperature of the fixing apparatus reached 170° C. and the fixing apparatus is held at 170° C. during this 1 minute, the image forming apparatus is transferred to the energy-saving mode after the 1 minute, the processor unit turns off the fixing lamp, the heating of the fixing apparatus is stopped and the actual temperature of the fixing apparatus begins to fall. This state is maintained until the next print job is received, at this time, the processing unit turns on the fixing lamp again, the abnormality determination of the temperature sensor starts until the fixing apparatus is heated to 170° C. and the image forming apparatus starts to print.

Figure 3:
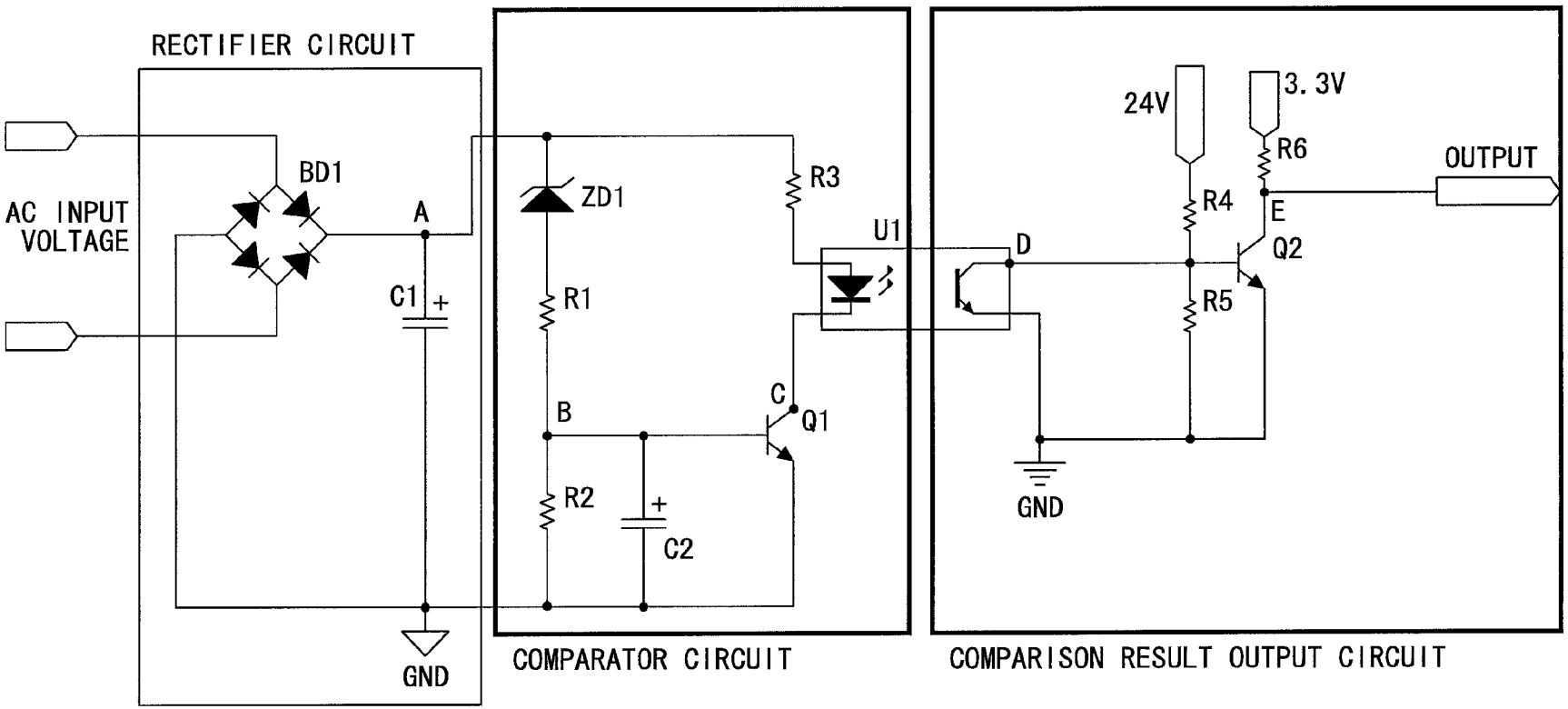
FIG. 3 is a block diagram illustrating the input voltage detection and comparison circuit according to the first embodiment of the present invention.

FIG. 3 is a block diagram illustrating the input voltage detection and comparison circuit according to the first embodiment of the present invention. The input voltage detection and comparison circuit according to the first embodiment of the present invention comprises a rectifier circuit, a comparator circuit and a comparison result output circuit.

The rectifier circuit is configured to convert the AC voltage Vac which is input into the image forming apparatus, into a DC voltage Vdc that is the detected input voltage. The rectifier circuit comprises a bridge rectifier circuit BD1 and a filter capacitor C1, the AC voltage Vac which is input into the image forming apparatus, is connected in parallel between both ends of one diagonal line of the bridge rectifier circuit BD1, and both ends of the other diagonal line of the bridge rectifier circuit BD1 are connected in parallel to the filter capacitor C1.

The comparator circuit is configured to compare the value of the DC voltage Vdc and the DC voltage Vdc' in a case where the predetermined voltage Vac'=220V. The comparator circuit comprises a voltage regulator diode ZD1, resistors R1 to R3, a transistor Q1 and a light emitting diode of a photoelectric converter U1. The voltage regulator diode ZD1, the resistors R1 and R2 are sequentially connected in series to form a series circuit, both ends of the series circuit are connected in parallel to both ends of the other diagonal line of the rectifier circuit BD1, a connection point between the resistors R1 and R2 is connected to the base of the transistor Q1, the emitter of the transistor Q1 is connected to an end of the series circuit where the resistor R2 is located, the collector of the transistor Q1, the light emitting diode and the resistor R3 are sequentially connected in series, and an end after connecting in series where the resistor R3 is located, is connected to the other end of the series circuit where the voltage regulator diode ZD1 is located.

The comparison result output circuit is configured to transmit the comparison result obtained by the comparator circuit to the processor unit. The comparison result output circuit comprises a photoelectric diode of the photoelectric converter U1, resistors R4 to R6 and a transistor Q2. The resistor R4 and R5 are connected in series, the other end of the resistor R4 after connecting in series is connected to a 24V DC power supply source, the other end of the resistor R5 after connecting in series is connected to the emitter of the transistor Q2, the end where the resistor R4 and R5 are connected in series, is connected to the base of the transistor Q2, the photoelectric diode is connected in parallel to the resistor R5, the collector of the transistor Q2 is connected to the resistor R6, the other end of the resistor R6 is connected to a 3.3V DC power supply source, the output of the input voltage detection and comparison circuit is led from a connection point between the collector of the transistor Q2 and the resistor R6, and the comparison result is transmitted to the processor unit.

Next, the operation process of the input voltage detection and comparison circuit will be described with reference to a detailed example. For example, it is set that Vzd1=309V, R1=400 KΩ, R2=80 KΩ, R4=800 KΩ, R5=20 KΩ, and the cut-in voltage of the transistors Q1 and Q2 is 0.5V.

First, an AC voltage Vac which is input to the image forming apparatus, is rectified into a DC voltage Vdc via a bridge rectifier circuit BD1. Although the AC voltages rectified from different DC voltages vary, there is a constant ratio relationship, for example, Vdc≈1.414Vac. Next, Vb is obtained from Vdc by dividing by the voltage regulator diode ZD1, resistors R1 and R2, and Vb=(Vdc−Vzd1)*[R2/(R1+R2)]. If Vb≥0.5V, the transistor Q1 becomes turned-on, point C becomes a low level, the light-emitting diode of the photoelectric converter U1 becomes turned-on and emits, thereby the photoelectric diode of the photoelectric converter U1 becomes turned-on, point D becomes a low level, and the transistor Q2 becomes turned-off; at this time, the output of the input voltage detection and comparison, namely, point E becomes a high level. If Vb<0.5V, the transistor Q1 becomes turned-off, point C becomes a high level, the light-emitting diode of the photoelectric converter U1 does not emit, thereby the photoelectric diode of the photoelectric converter U1 also becomes turned-off, point D becomes a high level, and the transistor Q2 becomes turned-on when point D is a high level since Vd=24V*R5/(R4+R5)=0.59V>0.5V; at this time, the output of the input voltage detection and comparison, namely, point E becomes a low level.

If the input voltage Vac=221V, Vdc≈1.414Vac=312.5V; at this time, point E becomes a high level, since Vb=(Vdc−Vzd1)*[R2/(R1+R2)]=(312.5−309)*[80/(400+80)]=0.58V>0.5V. If the input voltage Vac=220V, Vdc≈1.414Vac=311.1V; at this time, point E becomes a low level, since Vb=(Vdc−Vzd1)*[R2/(R1+R2)]=(311.1−309)*[80/(400+80)]=0.35V<0.5V.

Therefore, if Vzd1=309V, R1=400 KΩ and R2=80 KΩ, it is possible to determine whether the input voltage is greater than 220V or not. If the input voltage Vac>220V, the input voltage detection and comparison circuit outputs a high level to the processor unit; if the input voltage Vac≤220V, the input voltage detection and comparison circuit outputs a low level to the processor unit.

The Second Embodiment

In the following, the method for determining abnormality of the temperature sensor used in the image forming apparatus according to the second embodiment of the present invention will be described with reference to FIGS. 1, 2, 4 and 5. In the second embodiment, FIG. 1 is a schematic drawing illustrating a fixing control circuit of the image forming apparatus in which the input voltage detection circuit is added according to the present invention.

The fixing control circuit of the image forming apparatus comprises: an input voltage Vac; an input voltage detection circuit configured to detect an input voltage which is input into the image forming apparatus, and outputs the detected input voltage; a relay and a triac; a relay switch and a triac switch; a fixing lamp; a fixing apparatus configured to fix toner for forming the image onto a sheet; a processor unit configured to process data from units of the image forming apparatus and control operation of the image forming apparatus; a temperature sensor configured to detect an actual temperature of the fixing apparatus; and other units.

After the power of the image forming apparatus is turned ON, the processor unit turns on the relay and the triac switch, so that the fixing lamp is turned on, a 24V power supply is output to the fixing control circuit by the relay and the triac, and the heating of the fixing apparatus starts.

FIG. 2 is an example illustrating control curves of the light of the fixing lamp in different conditions of the input voltage. The curves A, B, C and D in FIG. 2 represent the control curves of the light of the fixing lamp in cases where the input voltage Vac≤180V, 180V<Vac≤200V, 200V<Vac≤220V and Vac>220V, respectively. The control curves are approximated to straight lines. As illustrated in FIG. 2, the temperature variation amount of the fixing in input voltage regions are ΔA=4° C., ΔB=6° C., ΔC=7° C. and ΔD=8° C., respectively, when the time period Δt=1.5 s, where ΔD is the first reference temperature variation amount of the present embodiment, and ΔA, ΔB and ΔC is the second reference temperature variation amount of the present embodiment.

In the second embodiment, the input voltages of the image forming apparatus in a range of voltages below the predetermined voltage Vac'=220V, are divided into a number of continuous input voltage regions, and a range exceeding 220V is also set as a input voltage region. The second reference temperature variation amount is a predetermined set of values as described above, and the values of the predetermined set of values correspond to the different input voltage regions, respectively. for example, ΔA, ΔB, ΔC and ΔD correspond to Vac≤180V, 180V<Vac≤200V, 200V<Vac≤220V and Vac>220V, respectively.

Next, how to apply the method for determining abnormality of the temperature sensor in the image forming apparatus will be described with reference to a detailed example.

Figure 5:
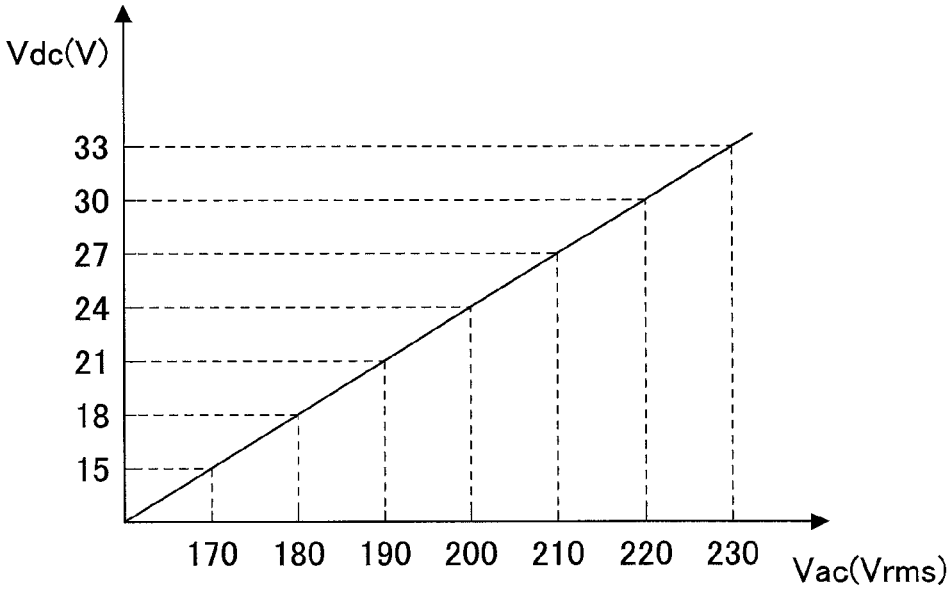
FIG. 5 is an example illustrating the proportional relation between the output DC voltage to the input AC voltage according to the second embodiment.

First, after the power of the image forming apparatus is turned ON, the fixing lamp is turned on and the heating of the fixing apparatus starts. At this time, the temperature sensor detects the actual temperature of the fixing apparatus in real-time and transmits the detected actual temperature to the processor unit via an interface of the processor unit; at the same time, the input voltage detection circuit begins to detect the AC voltage, which is input into the image forming apparatus, in real-time. Then, the processor unit calculates an actual temperature difference between both ends of a 1.5 s time period Δt as an actual temperature variation amount ΔT based on an actual temperature from the temperature sensor; and the input voltage detection circuit steps down and rectifies the input voltage Vac to a DC voltage Vdc which is proportional to Vac, and outputs Vdc to the processor unit, as illustrated in FIG. 5. The processor unit calculates the input voltage Vac corresponding to Vdc, and further determines the input voltage region where Vac is located so as to determine the corresponding reference temperature variation amount based on the input voltage region.

The processor unit extracts the predetermined ΔD=8° C. as the first reference temperature variation amount and compares the actual temperature variation amount ΔT calculated by the processor unit and ΔD, if the input voltage Vac is greater than the predetermined voltage 220V. The processor unit further determines that the temperature sensor is normal, controls the image forming apparatus so as to operate the image forming apparatus normally, makes the fixing lamp remain in a lighting state and makes the fixing apparatus keep heating, if ΔT≥ΔD; and the processor unit further determines that the temperature sensor is abnormal, turns off the relay and the triac switch so that the fixing lamp is turned off and the relay and the triac stop outputting the power supply 24V to the fixing control circuit, makes the fixing apparatus stop heating, and stops the operation of the image forming apparatus, if ΔT<ΔD.

The processor unit determines that Vac belongs to the input voltage region of 180V<Vac≤200V, extracts the predetermined ΔB=6° C. as the second reference temperature variation amount and compares the actual temperature variation amount calculated by the processor unit ΔT and ΔB, if the input voltage Vac is equal to or less than the predetermined voltage 220V, for example, Vac=190V. The processor unit further determines that the temperature sensor is normal, controls the image forming apparatus so as to operate the image forming apparatus normally, makes the fixing lamp remain in a lighting state and makes the fixing apparatus keep heating, if ΔT≥ΔB; and the processor unit further determines that the temperature sensor is abnormal, turns off the relay and the triac switch so that the fixing lamp is turned off and the relay and the triac stop outputting the power supply 24V to the fixing control circuit, makes the fixing apparatus stop heating, and stops the operation of the image forming apparatus, if ΔT<ΔB.

The abnormality determination of the temperature sensor is performed repeatedly during operation of the image forming apparatus.

If the temperature sensor is normal and the detected actual temperature of the fixing apparatus has reached 170° C. and there is an image processing job such as a print job in the image processing apparatus, the image forming apparatus starts printing when the actual temperature of the fixing apparatus reaches 170° C. If there is not a print job within 1 minute after the actual temperature of the fixing apparatus reached 170° C. and the fixing apparatus is held at 170° C. during this 1 minute, the image forming apparatus is transferred to the energy-saving mode after the 1 minute, the processor unit turns off the fixing lamp, the heating of the fixing apparatus is stopped and the actual temperature of the fixing apparatus begins to fall. This state is maintained until the next print job is received, at this time, the processing unit turns on the fixing lamp again, the abnormality determination of the temperature sensor starts until the fixing apparatus is heated to 170° C. and the image forming apparatus starts to print.

Figure 4:
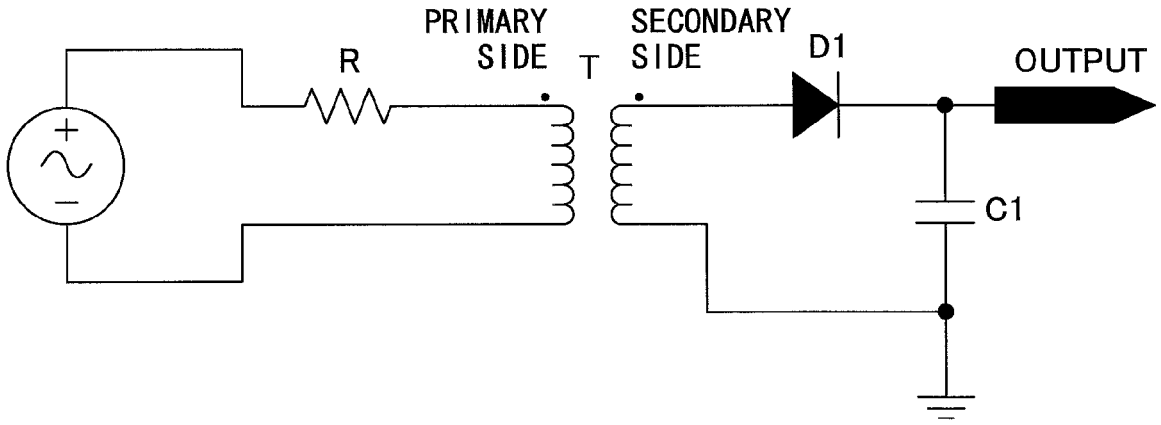
FIG. 4 is a block diagram illustrating the input voltage detection circuit according to the second embodiment of the present invention.

FIG. 4 is a block diagram illustrating the input voltage detection circuit according to the second embodiment of the present invention. The input voltage detection circuit according to the second embodiment of the present invention comprises a step-down circuit, and a rectifier and output circuit.

The step-down circuit is configured to step down the AC voltage Vac which is input into the image forming apparatus. The step-down circuit comprises a step-down resistor R and a transformer T. The transformer T has a primary side and a secondary side, the step-down resistor R is connected in series to the primary side of the transformer T to form a series circuit, and the formed series circuit is connected in parallel to the AC voltage Vac which is input into the image forming apparatus.

The rectifier and output circuit is configured to rectify the AC voltage Vac stepped down by the step-down circuit into a DC voltage Vdc that is the detected input voltage, and transmit the DC voltage Vdc to the processor unit. The rectifier and output circuit comprises a rectifier diode D1 and a filter capacitor C1. The rectifier diode D1 is connected in series to the secondary side of the transformer T to form a series circuit, the series circuit is connected in parallel to the filter capacitor C1, one end of the filter capacitor C1 is set as the output of the rectifier and output circuit, and the DC voltage Vdc after rectification which is proportional to Vac, is transmitted to the processor unit, as illustrated in FIG. 5.

In the above embodiments, as an example, the input voltage which is input into the image forming apparatus is an AC voltage as described above; However, the input voltage of the image forming apparatus may also be a DC voltage in the present invention.

The present invention is not limited to the specifically disclosed embodiments, and variations and modifications may be made without departing from the scope of the present invention.

The present application is based on and claims the benefit of priority of Chinese Priority Application No. 201210375487.2 filed on Sep. 27, 2012, the entire contents of which are hereby incorporated by reference.

What is claimed is:

1. A method for determining abnormality of a temperature sensor used in an image forming apparatus, comprising the steps of:

detecting an actual temperature of a fixing apparatus of the image forming apparatus and an input voltage which is input into the image forming apparatus;

calculating an actual temperature variation amount of the actual temperature between a start time and an end time of a predetermined time period;

comparing the detected input voltage and a predetermined voltage; comparing the calculated actual temperature variation amount and a predetermined first reference temperature variation amount if the input voltage is greater than the predetermined voltage; determining that the temperature sensor is normal if the actual temperature variation amount is equal to or greater than the first reference temperature variation amount; and determining that the temperature sensor is abnormal if the actual temperature variation amount is less than the first reference temperature variation amount; and comparing the calculated actual temperature variation amount and a predetermined second reference temperature variation amount which is less than the first reference temperature variation amount if the input voltage is equal to or less than the predetermined voltage; determining that the temperature sensor is normal if the actual temperature variation amount is equal to or greater than the second reference temperature variation amount; and determining that the temperature sensor is abnormal if the actual temperature variation amount is less than the second reference temperature variation amount.

2. The method for determining abnormality of a temperature sensor according to claim 1, further comprising the step of:

controlling the image forming apparatus so as to operate the image forming apparatus normally if it is determined that the temperature sensor is normal, and controlling the image forming apparatus so as to stop the operation of the image forming apparatus if it is determined that the temperature sensor is abnormal.

3. The method for determining abnormality of a temperature sensor according to claim 1, wherein the second reference temperature variation amount is a predetermined value.

4. The method for determining abnormality of a temperature sensor according to claim 1, wherein the input voltages of the image forming apparatus in a range of voltages below the predetermined voltage are divided into a number of continuous input voltage regions, the second reference temperature variation amount is a predetermined set of values, and the values of the predetermined set of values correspond to the different input voltage regions, respectively.

5. An image forming apparatus for forming an image on a sheet, comprising:

a fixing apparatus configured to fix toner for forming the image onto the sheet;

a temperature sensor configured to detect an actual temperature of the fixing apparatus;

an input voltage detection and comparison circuit configured to detect an input voltage which is input into the image forming apparatus, compare the input voltage and a predetermined voltage, and output a comparison result; and a processor unit, wherein the processor unit receives the actual temperature of the fixing apparatus detected by the temperature sensor and the comparison result of the voltages output by the input voltage detection and comparison circuit, and calculates an actual temperature variation amount of the actual temperature between a start time and an end time of a predetermined time period, wherein the processor unit compares the calculated actual temperature variation amount and a predetermined first reference temperature variation amount if the comparison result is that the input voltage is greater than the predetermined voltage, determines that the temperature sensor is normal if the actual temperature variation amount is equal to or greater than the first reference temperature, and determines that the temperature sensor is abnormal if the actual temperature variation amount is less than the first reference temperature, wherein the processor compares the calculated actual temperature variation amount and a predetermined second reference temperature variation amount which is less than the first reference temperature variation amount if the comparison result is that the input voltage is equal to or less than the predetermined voltage, determines that the temperature sensor is normal if the actual temperature variation amount is equal to or greater than the second reference temperature, and determines that the temperature sensor is abnormal if the actual temperature variation amount is less than the second reference temperature.

6. The image forming apparatus according to claim 5, wherein the processor unit controls the image forming apparatus so as to operate the image forming apparatus normally if the processor unit determines that the temperature sensor is normal, and controls the image forming apparatus so as to stop the operation of the image forming apparatus if the processor unit determines that the temperature sensor is abnormal.

7. The image forming apparatus according to claim 5, wherein the second reference temperature variation amount is a predetermined value.

8. The image forming apparatus according to claim 5, wherein the input voltage which is input into the image forming apparatus is an AC voltage, wherein the input voltage detection and comparison circuit comprises a rectifier circuit configured to convert the AC voltage which is input into the image forming apparatus into a DC voltage that is the detected input voltage;

a comparator circuit configured to compare the value of the DC voltage and the predetermined voltage; and a comparison result output circuit configured to transmit the comparison result obtained by the comparator circuit to the processor unit.

9. The image forming apparatus according to claim 8, wherein the rectifier circuit comprises a bridge rectifier circuit and a filter capacitor, the AC voltage which is input into the image forming apparatus is connected in parallel between both ends of one diagonal line of the bridge rectifier circuit, and both ends of the other diagonal line of the bridge rectifier circuit are connected in parallel to the filter capacitor, wherein the comparator circuit comprises a voltage regulator diode, a first resistor, a second resistor, a third resistor, a first transistor and a light emitting diode of a photoelectric converter, the voltage regulator diode, the first resistor and the second resistor are sequentially connected in series to form a series circuit, both ends of the series circuit are connected in parallel to both ends of the other diagonal line of the rectifier circuit, a connection point between the first resistor and the second resistor is connected to the base of the first transistor, the emitter of the first transistor is connected to an end of the series circuit where the second resistor is located, the collector of the first transistor, the light emitting diode and the third resistor are sequentially connected in series, and an end after connecting in series where the third resistor is located, is connected to the other end of the series circuit where the voltage regulator diode is located, wherein the comparison result output circuit comprises a photoelectric diode of the photoelectric converter, a fourth resistor, a fifth resistor, a sixth resistor and a second transistor, the fourth resistor and the fifth resistor are connected in series, the other end of the fourth resistor after connecting in series is connected to one DC power supply source, the other end of the fifth resistor after connecting in series is connected to the emitter of the second transistor, the end where the fourth resistor and the fifth resistor are connected in series is connected to the base of the second transistor, the photoelectric diode is connected in parallel to the fifth resistor, the collector of the second transistor is connected to the sixth resistor, the other end of the sixth resistor is connected to another one DC power supply source, the output of the input voltage detection and comparison circuit is led from a connection point between the collector of the second transistor and the sixth resistor, and the comparison result is transmitted to the processor unit.

10. An image forming apparatus for forming an image on a sheet, comprising:

a fixing apparatus configured to fix toner for forming the image onto the sheet;

a temperature sensor configured to detect an actual temperature of the fixing apparatus;

an input voltage detection circuit configured to detect an input voltage which is input into the image forming apparatus, and output the detected input voltage; and a processor unit, wherein the processor unit receives the actual temperature of the fixing apparatus detected by the temperature sensor and the detected input voltage output by the input voltage detection circuit, and calculates an actual temperature variation amount of the actual temperature between a start time and an end time of a predetermined time period;

wherein the processor unit compares the input voltage and a predetermined voltage, compares the calculated actual temperature variation amount and a predetermined first reference temperature variation amount if the input voltage is greater than the predetermined voltage, determines that the temperature sensor is normal if the actual temperature variation amount is equal to or greater than the first reference temperature, and determines that the temperature sensor is abnormal if the actual temperature variation amount is less than the first reference temperature;

wherein the processor compares the calculated actual temperature variation amount and a predetermined second reference temperature variation amount which is less than the first reference temperature variation amount if the input voltage is equal to or less than the predetermined voltage, determines that the temperature sensor is normal if the actual temperature variation amount is equal to or greater than the second reference temperature, and determines that the temperature sensor is abnormal if the actual temperature variation amount is less than the second reference temperature.

11. The image forming apparatus according to claim 10, wherein the processor unit controls the image forming apparatus so as to operate the image forming apparatus normally if the processor unit determines that the temperature sensor is normal, and controls the image forming apparatus so as to stop the operation of the image forming apparatus if the processor unit determines that the temperature sensor is abnormal.

12. The image forming apparatus according to claim 10, wherein the input voltages of the image forming apparatus in a range of voltages below the predetermined voltage are divided into a number of continuous input voltage regions, the second reference temperature variation amount is a predetermined set of values, and the values of the predetermined set of values correspond to the different input voltage regions, respectively.

13. The image forming apparatus according to claim 10, wherein the input voltage which is input into the image forming apparatus is an AC voltage, wherein the input voltage detection circuit comprises a step-down circuit configured to step down the AC voltage which is input into the image forming apparatus; and a rectifier and output circuit configured to rectify the AC voltage stepped down by the step-down circuit into a DC voltage that is the detected input voltage, and transmit the DC voltage to the processor unit.

14. The image forming apparatus according to claim 13, wherein the step-down circuit comprises a step-down resistor and a transformer, the transformer has a primary side and a second side, the step-down resistor is connected in series to the primary side of the transformer to form a series circuit, and the formed series circuit is connected in parallel to the AC voltage which is input into the image forming apparatus, wherein the rectifier and output circuit comprises a rectifier diode and a filter capacitor, the rectifier diode is connected in series to the secondary side of the transformer to form a series circuit, the series circuit is connected in parallel to the filter capacitor, one end of the filter capacitor is set as the output of the rectifier and output circuit, and the DC voltage after rectification is transmitted to the processor unit.

* * * * *